US008987178B2

(12) United States Patent
Davies et al.

(10) Patent No.: US 8,987,178 B2
(45) Date of Patent: Mar. 24, 2015

(54) LUBRICATING COMPOSITION CONTAINING OVERBASED DETERGENT

(75) Inventors: Mark C. Davies, Belper (GB); Michael R. Sutton, Matlock (GB)

(73) Assignee: The Lubrizol Corporation, Wickliffe, OH (US)

( * ) Notice: Subject to any disclaimer, the term of this patent is extended or adjusted under 35 U.S.C. 154(b) by 362 days.

(21) Appl. No.: 12/810,193

(22) PCT Filed: Dec. 17, 2008

(86) PCT No.: PCT/US2008/087114
§ 371 (c)(1), (2), (4) Date: Sep. 15, 2010

(87) PCT Pub. No.: WO2009/085800
PCT Pub. Date: Jul. 9, 2009

(65) Prior Publication Data

US 2011/0015105 A1 Jan. 20, 2011

Related U.S. Application Data

(60) Provisional application No. 61/016,838, filed on Dec. 27, 2007.

(51) Int. Cl.

| | |
|---|---|
| ***C10M 129/10*** | (2006.01) |
| ***C10M 159/22*** | (2006.01) |
| ***C10M 159/20*** | (2006.01) |
| ***C10M 163/00*** | (2006.01) |

(52) U.S. Cl.

CPC ..... *C10M 129/10* (2013.01); *C10M 159/20* (2013.01); *C10M 159/22* (2013.01); *C10M 163/00* (2013.01); *C10M 2203/1006* (2013.01); *C10M 2205/0285* (2013.01); *C10M 2207/026* (2013.01); *C10M 2207/027* (2013.01); *C10M 2207/028* (2013.01); *C10M 2215/064* (2013.01); *C10M 2215/223* (2013.01); *C10M 2219/044* (2013.01); *C10M 2219/046* (2013.01); *C10M 2219/088* (2013.01); *C10M 2219/089* (2013.01); *C10M 2223/045* (2013.01); *C10N 2210/02* (2013.01); *C10N 2210/04* (2013.01); *C10N 2230/04* (2013.01); *C10N 2230/06* (2013.01); *C10N 2230/12* (2013.01); *C10N 2230/40* (2013.01); *C10N 2230/42* (2013.01); *C10N 2230/43* (2013.01); *C10N 2230/45* (2013.01); *C10N 2230/52* (2013.01); *C10N 2230/54* (2013.01); *C10N 2240/10* (2013.01)

USPC ..... 508/574; 508/280; 508/586; 508/291

(58) Field of Classification Search

USPC ..... 508/280, 574, 586, 291

See application file for complete search history.

(56) References Cited

U.S. PATENT DOCUMENTS

| | | | | |
|---|---|---|---|---|
| 2003/0216266 | A1 * | 11/2003 | Hirano et al. | 508/291 |
| 2006/0217271 | A1 * | 9/2006 | Brown et al. | 508/165 |
| 2007/0149419 | A1 | 6/2007 | Irving et al. | |

FOREIGN PATENT DOCUMENTS

| | | |
|---|---|---|
| EP | 0765931 | 5/2001 |
| EP | 1167497 | 1/2002 |
| EP | 1361263 | 11/2003 |
| EP | 1475430 | 11/2004 |
| WO | 03064568 | 8/2003 |
| WO | 2005061682 | 7/2005 |
| WO | WO 2005061682 A2 * | 7/2005 |

OTHER PUBLICATIONS

Corresponding PCT Publication No. WO 2009/095800 A1 published Jul. 9, 2009.

Written Opinion from corresponding International Application No. PCT/US2008/087114 dated Mar. 17, 2009.

* cited by examiner

*Primary Examiner* — James Goloboy

(74) *Attorney, Agent, or Firm* — Teresan W. Gilbert, Esq; David M. Shold, Esq.

(57) ABSTRACT

The invention provides a lubricating composition containing an oil of lubricating viscosity and a calcium-containing detergent with a soap content of 0.06 wt % to 1.6 wt % of the lubricating composition. The lubricating composition is suitable for lubricating an internal combustion engine.

21 Claims, No Drawings

LUBRICATING COMPOSITION CONTAINING OVERBASED DETERGENT

FIELD OF INVENTION

The invention provides a lubricating composition containing an oil of lubricating viscosity and a calcium-containing detergent with a soap content of 0.06 wt % to 1.6 wt % of the lubricating composition. The lubricating composition is suitable for lubricating an internal combustion engine.

BACKGROUND OF THE INVENTION

Engine lubricants containing phosphorus compounds and sulphur have been shown to contribute in part to particulate emissions and emissions of other pollutants. In addition, sulphur and phosphorus tend to poison the catalysts used in catalytic converters, resulting in a reduction in performance of said catalysts.

With increasing control of emissions (emissions often being associated with contributing to $NO_x$ formation, $SO_x$ formation, formation of particulate matter, formation of ash and reducing the efficiency of after-treatment catalytic converters) there is a desire towards reduced amounts of sulphur, phosphorus and sulphated ash in engine oils. Emission standards such as Euro 4 or Euro 5 further limit the amounts of, for example, sulphated ash, phosphorus, sulphur and particulate matter.

In passenger car vehicles (which may also be referred to as vehicles containing "light-duty internal combustion engines (typically with an engine capacity of 6 liters or less)) the introduction of emission standards such as Euro 4 or Euro 5 is believed to increase the usage of after-treatment devices. After-treatment devices include but are not limited to particulate filters. In addition, the particulate filters are being added to diesel passenger car vehicles.

To reduce poisoning of after-treatment devices with sulphur, phosphorus or excessive amounts of ash, lubricants are required to be formulated with lower levels of sulphated ash, phosphorus and sulphur. The most recent limits on sulphur, phosphorus and ash are described within the 2004 ACEA sequences for light duty engine oils. In particular for the C category (i.e., Catalyst compatible) the limits are amongst the lowest required for a lubricant. Accordingly, the ACEA C1 and C4 are amongst the most demanding specifications to meet.

U.S. Patent Application 2007/0149419 discloses a lubricating oil composition for internal combustion engines, particularly heavy duty diesel (HDD) engines, having reduced phosphorus, sulphur and sulphated ash content that provides excellent piston cleanliness performance and contains an amount of phenate detergent that introduces a relatively large amount of phenate soap into the lubricating oil composition. In addition, the lubricating composition contains sulphonate detergent. Typically at least one of the phenate detergent or sulphonate detergent is a magnesium-containing detergent.

European Patent application 765 931 A discloses a lubricating composition for a heavy duty diesel engine containing a major amount of an oil of lubricating viscosity, a minor amount of a carbonated sulphurised metal alkyl phenate and a minor amount of a carbonated metal alkyl aryl sulphonate, wherein the total base equivalents donated by the phenate is more than 85% of the total equivalents donated by the phenate and sulphonate.

As passenger car engine technology develops, components of an engine are exposed to more severe operating conditions. Operating conditions may include higher power density engines, use of turbo chargers, and use of alternative fuels. Under many severe operating conditions, oxidation of lubricant and components occurs more readily.

SUMMARY OF THE INVENTION

The inventors of the present invention have identified lubricating composition that provide at least one of corrosion control, oxidation control, fuel economy control, cleanliness, sludge control, and antiwear performance. Typically, the present invention is capable of meeting the requirements of industry specifications such as ACEA C1 whilst maintaining the performance highlighted above.

In one embodiment the invention provides a lubricating composition comprising an oil of lubricating viscosity, and a calcium-containing detergent with a soap content of 0.06 wt % to 1.6 wt % of the lubricating composition.

In one embodiment the invention provides a lubricating composition comprising an oil of lubricating viscosity, and a calcium-containing phenate detergent with a soap content of 0.06 wt % to 1.6 wt % of the lubricating composition. In certain embodiments the calcium-containing phenate detergent may provide 0.06 to 1.6 wt % soap content to the lubricating composition; or alternatively the calcium-containing phenate detergent may provide a portion of this total amount of soap, the remainder being provided from other sources.

In one embodiment the invention provides a lubricating composition comprising an oil of lubricating viscosity and a calcium-containing phenate detergent with a soap content of 0.06 wt % to 1.6 wt % of the lubricating composition, wherein the lubricating composition has a total sulphate ash content of at most 0.5 wt % of the lubricating composition.

In one embodiment the soap content of the lubricating composition disclosed herein may be in the range of 0.06 wt % to less than 1.4 wt % of the lubricating composition.

In one embodiment the lubricating composition described herein further contains one or more dispersants. Typically the dispersant is an ashless dispersant. The dispersant may also contribute 0.03 wt % to less than 0.08 wt %, or 0.04 wt % to 0.07 wt % of the total nitrogen content of the lubricating composition.

In one embodiment the lubricating composition described herein may have a total base number (TBN) of 7 mg KOH/g or less, or 4 to 7 mg KOH/g.

In one embodiment the lubricating composition is characterised as having at least one of (i) a sulphur content of 0.8 wt % or less, (ii) a phosphorus content of 0.1 wt % or less, or (iii) a sulphated ash content of 0.5 wt % or less.

In one embodiment the invention the lubricating composition is characterised as having (i) a sulphur content of 0.5 wt % or less, (ii) a phosphorus content of 0.1 wt % or less, and (iii) a sulphated ash content of 0.5 wt % or less.

In one embodiment the invention provides a method of lubricating an internal combustion engine comprising supplying to the internal combustion engine a lubricating compositions as disclosed herein. Typically the internal combustion engine is a passenger car internal combustion engine. The passenger car internal combustion engine may have an engine capacity (that is, a piston cylinder displacement volume) of 6 liters or less, 5 liters or less, or 4 liters or less, 1 liter to 3 liters.

In one embodiment the invention provides for the use of the lubricating composition disclosed herein in a passenger car internal combustion engine for at least one of (i) control of fuel economy, (ii) control of corrosion, (iii) cleanliness, and (iv) control of bore wear.

DETAILED DESCRIPTION OF THE INVENTION

The present invention provides a lubricating composition and a method for lubricating an engine as disclosed above.

As used herein the term "soap" means the surfactant portion of a detergent and does not include a metal base, such as calcium carbonate. The soap term may also be referred to as a detergent substrate. For example, a phenate detergent soap or substrate is an alkylated phenol or a sulphur-coupled alkylated phenol, or a methylene-coupled alkylated phenol. Or for a sulphonate detergent, the soap or substrate is a neutral salt of an alkylbenzenesulphonic acid.

The lubricating composition may have a sulphur content of 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %.

The phosphorus content may be 0.2 wt % or less, or 0.1 wt % or less, or 0.085 wt % or less, or even 0.06 wt % or less, 0.055 wt % or less, or 0.05 wt % or less. In one embodiment the phosphorus content may be 100 ppm to 1000 ppm, 325 ppm to 700 ppm, or 300 ppm to 500 ppm.

The total sulphated ash content may be 0.75 wt % or less, or 0.5 wt % or less. In one embodiment the sulphated ash content may be 0.05 wt % to 0.5 wt %, or 0.1 wt % to 0.2 wt % to 0.45 wt %. In one embodiment the total sulphated ash content is 0.5 wt % or less of the lubricating composition.

In one embodiment the lubricating composition may have (i) a sulphur content of 0.5 wt % or less, (ii) a phosphorus content of 300 ppm to 500 ppm or less, and (iii) a sulphated ash content of 0.5 wt % or less.

Detergents

The calcium-containing detergent may be neutral or overbased. Overbased calcium-containing detergents are known in the art.

In one embodiment the calcium-containing detergent may be a phenate, a salixarate, a sulphonate, a salicylate, a hybrid detergent, or mixtures thereof. In one embodiment the calcium-containing detergent is a mixture of a phenate and a sulphonate.

Hybrid detergents may be formed with mixed surfactant systems including phenate and/or sulphonate components, e.g., phenate/salicylates, sulphonate/phenates, or sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

In one embodiment, lubricating oil compositions of the present invention are substantially free from carboxylate detergents (e.g., contain such detergents in an amount providing no more than about 0.5 grams of carboxylate soap per 100 grams of lubricating oil composition), or completely free from carboxylate detergent In one embodiment the lubricating composition is free of magnesium containing detergents.

In one embodiment the calcium-containing detergent may be a mixture of phenate and sulphonate detergents. When a mixture of calcium-containing detergents is used, the amount of sulphonate detergent (including the soap, basic metal such as calcium carbonate, and conventional amount of diluent oil) may be 0.01 wt % to 0.3 wt %, or 0.02 wt % to 0.15 wt %, of 0.05 to 0.1 wt % of the lubricating composition. The sulphonate detergent may have a TBN of 300 to 550, or 350 to 480.

The phenate may be a sulphur-containing phenate, a methylene-bridged phenate, or mixtures thereof. In one embodiment the phenate is sulphur-containing phenate.

In one embodiment the calcium-containing detergent is a calcium phenate and it is the only detergent in the lubricating composition.

Typically the sulphur containing phenate detergent has a TBN from 30 to 350, or 40 to 300, or 50 to 270, or 70 to 170. In one embodiment the sulphur containing phenate detergent has a TBN of 155. In one embodiment the sulphur containing phenate detergent has a TBN of 250. The sulphur containing phenate detergent may be used alone or with other sulphur containing phenate detergents. In one embodiment the sulphur containing phenate detergent is a mixture of phenate detergents.

The soap content of the calcium-containing detergent may be 0.06 wt % to 1.6 wt %, or 0.08 wt % to 1.4 wt %, or 1.0 wt % to 1.3 wt % of the lubricating composition. The calcium-containing detergent may contribute a total soap content at least 90 wt %, or greater than 92 wt %, 96 wt % or higher, or 96 wt % to 100 wt % of the total amount of soap present in the lubricating composition.

The lubricating composition may have a ratio of soap to sulphated ash of at least 2, or at least 2.2, or at least 2.5. In one embodiment the lubricating composition may have a ratio of soap to ash of 2 to 4.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content>0.03 wt %, and/or <90 wt % saturates, viscosity index 80-120); Group II (sulphur content≤0.03 wt %, and ≥90 wt % saturates, viscosity index 80-120); Group III (sulphur content≤0.03 wt %, and ≥90 wt % saturates, viscosity index≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof. In one embodiment the oil of lubricating viscosity may be a API Group III oil.

The amount of the oil of lubricating viscosity present is typically the balance remaining after subtracting from 100 wt % the sum of the amounts of the remaining ingredients, that is, performance additives (including ashless antiwear agent and oil-soluble molybdenum compound, if present).

The lubricating composition may be in the form of a concentrate and/or a fully formulated lubricant. If the lubricating composition of the invention (comprising the calcium-containing detergent) is in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives may comprise at least one of metal deactivators, viscosity modifiers, friction modifiers, antiwear agents, corrosion inhibitors, dispersants, dispersant viscosity modifiers, extreme pressure agents, antioxidants, foam inhibitors, demulsifiers, pour point depressants, seal swelling agents, titanium additives, oil-soluble molybdenum compounds, and mixtures thereof. Typically, fully-formulated lubricating oil will contain one or more of these performance additives.

In one embodiment the lubricating composition comprises an ashless antiwear agent and further comprises at least one of a viscosity modifier, an antioxidant, a succinimide dispersant, or mixtures thereof. In one embodiment the lubricating composition further comprises a phosphorus-containing antiwear agent.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range 350 to 5000, or 500 to 3000. Succinimide dispersants and their preparation are disclosed, for instance in U.S. Pat. No. 3,172,892 or U.S. Pat. No. 4,234,435. Succinimide dispersants are typically the imide formed from a polyamine, typically a poly(ethyleneamine). Dispersants made from polyisobutylene succinic anhydrides prepared from the "thermal ene" process are described in the literature, for example European Patent Application 0 355 895 A2.

In one embodiment the invention further comprises at least one dispersant derived from polyisobutylene succinimide with number average molecular weight in the range 350 to 5000, or 500 to 3000. The polyisobutylene succinimide may be used alone or in combination with other dispersants.

In one embodiment the invention further comprises at least one dispersant derived from polyisobutylene succinic anhydride, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

In one embodiment the invention contains a mixture of dispersants, also referred to herein as a dispersant package. The dispersant package may contain (i) a dispersant with a carbonyl to nitrogen ratio of 1 or higher; and (ii) a dispersant with a carbonyl to nitrogen ratio of less than 1. Dispersants (i) and/or (ii) may be made using acylating agents which are in turn prepared by "thermal ene" process known to the skilled person.

The dispersants of the invention are often derived from N-substituted long chain alkenyl succinimides. When present as a dispersant package, one dispersant may have a high Total Base Number; and one may have a high Total Acid Number. Generally dispersants with a high TAN number have a carbonyl to nitrogen ratio of 1 or higher, in one embodiment 1.2 or higher, in another embodiment 1.4 or higher and in yet another embodiment 1.45 or higher, for example 1.5. Generally dispersants with a high TBN number have a carbonyl to nitrogen ratio of less than 1, in one embodiment 0.94 or lower, in another embodiment 0.88 or lower and in another embodiment 0.8 or lower, for instance 0.77. The carbonyl to nitrogen ratio is to be calculated on a molar basis, that is, the ratio of moles of carbonyl functionality (e.g., —C(O)—) to the moles of nitrogen functionality (e.g., amine nitrogens).

The dispersant or dispersant package is often present on an oil free basis at 0.01 to 30, in one embodiment 0.5 to 25, in another embodiment 1.5 to 20 and in yet another embodiment 3 to 15 weight percent of the composition. Often the dispersant, in a dispersant package, with a high Total Base Number is present at lower concentration than the dispersant with a high Total Acid Number. Alternatively the amount of dispersant with a high Total Acid Number and a high Total Base Number is equal. In yet another alternative the dispersant with a high Total Acid Number is often present at lower concentration than the dispersant with a high Total Base Number. Often the dispersant present in the greater quantity is present at greater than 50% of the amount of dispersant present in the dispersant package, in one embodiment greater than 55% of the amount of dispersant present in the dispersant package, in yet another embodiment greater than 60% of the amount of dispersant present in the dispersant package. For example the dispersant present in the greater quantity may be present from 61% to 95% of the dispersant, in one embodiment 62% to 90% of the dispersant and in yet another embodiment 63% to 85% of the dispersant present in the dispersant package. In one embodiment the ratio of high TAN dispersant to high TBN dispersant is 1:1 to 15:1, in another embodiment 2:1 to 10:1 and in another embodiment 3:1 to 6:1.

The dispersant may be present at 0 wt % to 20 wt %, or 0.1 wt % to 15 wt %, or 0.1 wt % to 10 wt %, or 1 wt % to 6 wt %, or 7 wt % to 12 wt % of the lubricating composition.

Antioxidants

Antioxidant compounds are known and include for example, sulphurised olefins (typically sulphurised 4-carbobutoxy cyclohexane, or triphenylphosphite equivalents thereof, or olefin sulphide), alkylated diphenylamines (typically di-nonyl diphenylamine, octyl diphenylamine, di-octyl diphenylamine), hindered phenols, or mixtures thereof. Antioxidant compounds may be used alone or in combination. The antioxidant may be present in ranges 0 wt % to 20 wt %, or 0.1 wt % to 10 wt %, or 0.4 wt % to 5 wt %, of the lubricating composition.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba or a condensation product derived from 2,6-di-tert-butylphenol and an alkyl acrylate, wherein the alkyl group may contain 1 to 18, or 2 to 12, or 2 to 8, or 2 to 6, or 4 carbon atoms. A more detailed description of suitable ester-containing hindered phenol antioxidant chemistry is found in U.S. Pat. No. 6,559,105.

Viscosity Modifiers

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl aryl conjugated diene copolymers, polyolefins, esters of maleic anhydride-styrene copolymers, or esters of (alpha-olefin maleic anhydride) copolymers, or mixtures thereof.

Dispersant Viscosity Modifiers

Dispersant viscosity modifiers (often referred to as DVMs), include functionalised polyolefins, for example, ethylene-propylene copolymers that have been functionalised with the reaction product of an acylating agent (such as maleic anhydride) and an amine; polymethacrylates functionalised with an amine, or esterified maleic anhydride-styrene copolymers reacted with an amine.

The total amount of viscosity modifier and/or dispersant viscosity modifier may be 0 wt % to 25 wt %, 0.1 wt % to 20 wt %, or 0.1 wt % to 15 wt %, of the lubricating composition.

Antiwear Agents

The lubricant composition optionally further comprises at least one other antiwear agent. Examples of suitable antiwear agents include phosphate esters, sulphurised olefins, sulphur-containing anti-wear additives including metal dihydrocarbyldithiophosphates (such as zinc dialkyldithiophosphates), thiocarbamate-containing compounds including, thiocarbamate esters, alkylene-coupled thiocarbamates, and bis(S-alkyldithiocarbamyl)disulphides.

Zinc dialkyldithiophosphates may generally be represented by the formula

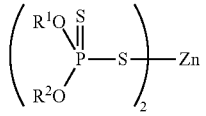

The $R^1$ and $R^2$ groups are independently hydrocarbyl groups that may be free from acetylenic and often also from ethylenic unsaturation. They are typically alkyl, cycloalkyl, aralkyl or alkaryl group and have 3 to 20 carbon atoms, such as 3 to 16 carbon atoms or up to 13 carbon atoms, e.g., 3 to 12 carbon atoms. The alcohol which reacts to provide the $R^1$ and $R^2$ groups can be a mixture of a secondary alcohol and a primary alcohol, for instance, a mixture of 2-ethylhexanol and isopropanol or, alternatively, a mixture of secondary alcohols such as isopropanol and 4-methyl-2-pentanol. Such materials are well known and readily available to those skilled in the art of lubricant formulation. In one embodiment the zinc dialkyldithiophosphates may be primary zinc dialkyldithiophosphates. In one embodiment the zinc dialkyldithiophosphates may be secondary zinc dialkyldithiophosphates.

In certain embodiments, examples of suitable zinc dialkyldithiophosphates include those disclosed in PCT Application US07/073428 (entitled "Method of Lubricating an Internal Combustion Engine and Improving the Efficiency of the Emissions Control System of the Engine") or in PCT Application US07/073426 (entitled "Lubricating Oil Composition and Method of Improving Efficiency of Emissions Control System"). Both applications claim priority from Jul. 17, 2006. The zinc dialkyldithiophosphates described therein may be defined as a zinc salt of a mixture of phosphorus-containing compounds represented by the formula:

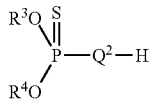

wherein $Q^1$ and $Q^2$ are independently S or O, and $R^3$ and $R^4$ are independently hydrocarbyl groups, the average total number of carbon atoms in $R^3$ plus $R^4$ for the mixture of phosphorus-containing compounds being at least 9.5; wherein $R^3$ and $R^4$ are characterised in that (i) 4 to 70 weight percent of such groups contain 2 to 4 carbon atoms and (ii) 30 to 96 weight percent such groups contain 5 to 12 carbon atoms; and wherein, in less than 8 mole percent of the molecules of Formula (2) in the mixture of phosphorus-containing compounds, each of $R^3$ and $R^4$ contain 2 to 4 carbon atoms and in greater than 11 mole percent of the molecules of Formula (2) in said mixture $R^3$ has 2 to 4 carbon atoms and $R^4$ has 5 to 12 carbon atoms; and wherein, within the formula above, the average total number of hydrogen atoms in $R^3$ and $R^4$ on carbon atoms located beta to the 0 atoms is at least 7.25. In one embodiment the lubricating composition is free of zinc dihydrocarbyl dithiophosphate. In one embodiment the lubricating composition further includes a zinc dihydrocarbyl dithiophosphate.

The dithiocarbamate-containing compounds may be prepared by reacting a dithiocarbamate acid or salt with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form an the sulphurised olefin include propylene, butylene, isobutylene, pentene, hexene, heptene, octene, nonene, decene, undecene, dodecene, undecyl, tridecene, tetradecene, pentadecene, hexadecene, heptadecene, octadecene, nonodecene, eicosene or mixtures thereof. In one embodiment, hexadecene, heptadecene, octadecene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

In one embodiment, an ashless antiwear agent (which may also be described as a friction modifier) may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the ashless antiwear agent mixture include 5 to 95, or in other embodiments 10 to 90, or 20 to 85, or 20 to 80 weight percent of said mixture. The aliphatic carboxylic acids (especially a monocarboxylic acid) which form the esters are those acids typically containing 12 to 24 or 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butanediol; hexanediol; sorbitol; arabitol; mannitol; sucrose; fructose; glucose; cyclohexanediol; erythritol; and pentaerythritols, including di- and tripentaerythritol. Often the polyol is diethylene glycol, triethylene glycol, glycerol, sorbitol, pentaerythritol or dipentaerythritol. The commercial material is believed to include about 60±5 percent by weight of the chemical species "glycerol monooleate," along with 35±5 percent glycerol dioleate, and less than about 5 percent trioleate and oleic acid. The amounts of the monoesters, described below, are the amounts of the commercial grade material.

Other antiwear agents include various boron-containing compounds, some of which may also serve as corrosion inhibitors. The boron compound may be a soluble boron compound such as a borate ester. The borate ester (also known as a borated ester antiwear agent), may be one or more compounds represented by one or more of the formulas

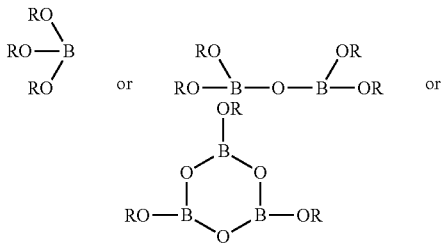

wherein each R may be independently an organic group and any two adjacent R groups may together form a cyclic group. Mixtures of two or more of the foregoing may be used. In one embodiment, each R may be independently a hydrocarbyl group. The total number of carbon atoms in the R groups in each formula may be sufficient to render the compound soluble in the base oil. Generally, the total number of carbon atoms in the R groups may be at least 8, and in one embodiment at least 10, and in one embodiment at least 12. There may be no limit to the total number of carbon atoms in the R groups that is required, but a practical upper limit may be 400 or 500 carbon atoms. In one embodiment, each R group may be independently a hydrocarbyl group of 1 to 100 carbon atoms, and in one embodiment 1 to 50 carbon atoms, and in one embodiment 1 to 30 carbon atoms, and in one embodiment 1 to 10 carbon atoms, with the proviso that the total number of carbons in the R group may be at least 8. Each R group may be the same as the other, although they may be different. Examples of useful R groups may include isopropyl, n-butyl, isobutyl, amyl, 1,3-dimethyl-butyl, 2-ethyl-1-hexyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, and alkylnaphthylalkyl.

In one embodiment, the borate ester may be a compound represented by the formula

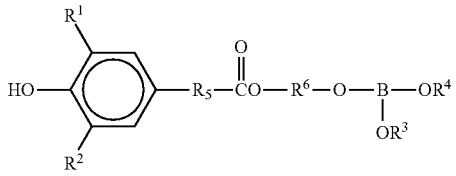

wherein $R_1$, $R_2$, $R_3$ and $R_4$ are independently hydrocarbyl groups of 1 to 12 carbon atoms; and $R_5$ and $R_6$ are independently alkylene groups of 1 to 6 carbon atoms, and in one embodiment 2 to 4 carbon atoms, and in one embodiment 2 or 3 carbon atoms. In one embodiment, $R_1$ and $R_2$ may independently contain 1 to 6 carbon atoms, and in one embodiment each may be a t-butyl group. In one embodiment, $R_3$ and $R_4$ are independently hydrocarbyl groups of 2 to 12 carbon atoms, and in one embodiment 8 to 10 carbon atoms. In one embodiment, $R_5$ and $R_6$ are independently —$CH_2CH_2$— or —$CH_2CH_2CH_2$—.

A useful borate ester may be available from Crompton Corporation under the trade designation LA-2607. This material may be identified as a phenolic borate having the structure represented above wherein $R^1$ and $R^2$ are each t-butyl, $R^3$ and $R^4$ are hydrocarbyl groups of 2 to 12 carbon atoms, $R^5$ is —$CH_2CH_2$—, and $R^6$ is —$CH_2CH_2CH_2$—.

In one embodiment, the borate ester may be a compound represented by the formula:

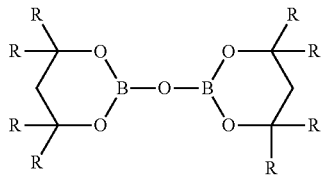

wherein the R groups are independently hydrogen or hydrocarbyl groups. Each of the hydrocarbyl groups may contain 1 to 12 carbon atoms, and in one embodiment 1 to 4 carbon atoms. An example is 2,2'-oxy-bis-(4,4,6-trimethyl-1,3,2-dioxaborinane).

In one embodiment, the borate ester may be a compound represented by the formula $B(OC_5H_{11})_3$ or $B(OC_4H_9)_3$. A useful boron-containing compound may be available from Mobil under the trade designation MCP-1286.

Other borate esters include borated epoxides, so termed because they may be prepared by reacting an epoxide with a boron source. Such materials may be represented by the formula

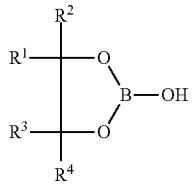

among other structures, where the Rs are hydrogen or hydrocarbyl groups. Borated epoxides are generally the reaction product of one or more reactive boron compounds such as boric acid or boron trioxide or certain borate esters with at least one epoxide. The epoxide is generally an aliphatic epoxide having 8 to 30, or 10 to 24, or 12 to 20 carbon atoms. Examples of useful aliphatic epoxides include heptyl epoxide, octyl epoxide, oleyl epoxide and the like. Mixtures of epoxides may also be used, for instance commercial mixtures of epoxides having 14 to 16 carbon atoms and 14 to 18 carbon atoms. The borated fatty epoxides are generally known and are disclosed in U.S. Pat. No. 4,584,115

The borate compound will typically be employed in the lubricating oil composition at a sufficient concentration to provide the lubricating oil composition with a boron concentration (as B) of at least 70 parts per million by weight. Such amounts are believed to impart superior oxidation performance when combined with the titanium compound as described above. Suitable ranges for the boron may include 70 to 1000 ppm or 85 to 150 ppm.

Other types of boron compounds include borated dispersants such as those described in greater detail in U.S. Pat. No. 6,596,672, see columns 13 and 14, as well as in U.S. Pat. Nos. 3,000,916; 3,087,936; 3,254,025; 3,282,955; 3,313,727; 3,491,025; 3,533,945; 3,666,662 and 4,925,983.

The antiwear agent may be present at 0 wt % to 5 wt %, or 0.1 to 4 wt % of the lubricating composition.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

In one embodiment the further comprises a friction modifier, or mixtures thereof. Typically the friction modifier may be present in ranges including 0 wt % to 10 wt %, or 0.01 wt % to 8 wt %, or 0.05 wt % to 4 wt % of the lubricating composition.

Examples of suitable friction modifiers include long chain fatty acid derivatives such as amines, esters, or epoxides; fatty imidazolines; and amine salts of alkylphosphoric acids.

Friction modifiers may also encompass materials such as sulphurised fatty compounds and olefins, triglycerides (e.g. sunflower oil) or monoester of a polyol and an aliphatic carboxylic acid (all these friction modifiers have been described as antioxidants or antiwear agents).

In one embodiment the friction modifier is a long chain fatty acid derivatives of amines, esters, or epoxides.

In one embodiment the friction modifier is a long chain fatty acid ester (previously described above as an ashless antiwear agent). In another embodiment the long chain fatty acid ester is a mono-ester and in another embodiment the long chain fatty acid ester is a (tri)glyceride.

Oil-Soluble Molybdenum Compound

An oil-soluble molybdenum compound may also be present and may have the functional performance of an antiwear agent, an antioxidant, a friction modifier, or mixtures thereof. Typically, the oil-soluble molybdenum compound includes molybdenum dithiocarbamates, molybdenum dialkyldithiophosphates, amine salts of molybdenum compounds, molybdenum xanthates, molybdenum sulphides, molybdenum carboxylates, molybdenum alkoxides, or mixtures thereof. The molybdenum sulphides include molybdenum disulphide. The molybdenum disulphide may be in the form of stable dispersions. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound is a molybdenum dithiocarbamate.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165, S-515, and S-600 from Asahi Denka Kogyo K. K and mixtures thereof.

The oil-soluble molybdenum compound may be present in an amount sufficient to provide 0.5 ppm to 2000 ppm, 1 ppm to 700 ppm, 1 ppm to 550 ppm, 5 ppm to 300 ppm, or 20 ppm to 250 ppm of molybdenum.

In one embodiment the lubricating composition is free of oil-soluble molybdenum compound. In one embodiment the lubricating composition contains an oil-soluble molybdenum compound.

Titanium Additives

The present invention may also comprise titanium in the form of an oil-soluble titanium-containing additive, material or, more generally, a hydrocarbon-soluble material. The titanium additives may be useful for deposit control, oxidation control or control of filterability. Titanium additives and their methods of preparation have been disclosed in U.S. Patent Application 2006-0217271, Brown et al., Sep. 28, 2006. By "oil-soluble" or "hydrocarbon soluble" is meant a material which will dissolve or disperse on a macroscopic or gross scale in an oil or hydrocarbon, as the case may be, typically a mineral oil, such that a practical solution or dispersion can be prepared. In order to prepare a useful lubricant formulation, the titanium material should not precipitate or settle out over a course of several days or weeks. Such materials may exhibit true solubility on a molecular scale or may exist in the form of agglomerations of varying size or scale, provided however that they have dissolved or dispersed on a gross scale.

The nature of the oil-soluble titanium-containing material can be diverse. Such materials are described, for example, in U.S. Patent Publication US 2006-0217271, Brown et al. Among the titanium compounds that may be used in—or which may be used for preparation of the oils-soluble materials of—the present invention are various Ti(IV) compounds such as titanium(IV)oxide; titanium(IV)sulfide; titanium(IV) nitrate; titanium(IV)alkoxides such as titanium methoxide, titanium ethoxide, titanium propoxide, titanium isopropoxide, titanium butoxide; and other titanium compounds or complexes including but not limited to titanium phenates; titanium carboxylates such as titanium(IV)2-ethyl-1-3-hexanedioate or titanium citrate or titanium oleate; titanium(IV) 2-ethylhexoxide; and titanium(IV)(triethanolaminato)-isopropoxide. Other forms of titanium encompassed within the present invention include titanium phosphates such as titanium dithiophosphates (e.g., dialkyldithiophosphates) and titanium sulfonates (e.g., alkylsulfonates), or, generally, the reaction product of titanium compounds with various acid materials to form salts, especially oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In another embodiment, the titanium can be supplied as a Ti-modified dispersant. Dispersants are described in greater detail below. An example of a dispersant is a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-)succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alchohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 g+diluent oil) at 150° C. for 1.5 hours, to produce a titanium-modified succinimide dispersant.

In another embodiment, the titanium can be supplied as a tolyltriazole oligomer salted with and/or chelated to titanium. The surface active properties of the tolyltriazole allow it to act as a delivery system for the titanium, imparting both the titanium performance benefits as elsewhere described herein, as well as anti-wear performance of tolyltriazole. In one embodiment, this material can be prepared by first combining tolyltriazole (1.5 eq) and formaldehyde (1.57 eq) in an inert solvent followed by addition of diethanolamine (1.5 eq) and then hexadecyl succinic anhydride (1.5 eq) and a catalytic amount of methanesulfonic acid, while heating and removing water of condensation. This intermediate can be reacted with titanium isoproxide (0.554 eq) at 60° C., followed by vacuum stripping to provide a red viscous product.

Other forms of titanium can also be provided, such as surface-modified titanium dioxide nanoparticles, as described in greater detail in Q. Xue et al., Wear 213, 29-32, 1997 (Elsevier Science S.A.), which discloses TiO2 nanoparticles with an average diameter of 5 nm, surface modified with 2-ethylhexoic acid. Such nanoparticles capped by an organic hydrocarbyl chain are said to disperse well in non-polar and weakly polar organic solvents. Their synthesis is described in greater detail by K. G. Severin et al. in Chem. Mater. 6, 8990-898, 1994.

In one embodiment, the titanium is not a part of or affixed to a long-chain polymer, that is, a high molecular weight polymer. Thus, the titanium species may, in these circumstances, have a number average molecular weight of less than 150,000 or less than 100,000 or 30,000 or 20,000 or 10,000 or 5000, or 3000 or 2000, e.g, about 1000 or less than 1000. Non-polymeric species providing the titanium as disclosed above will typically be below the molecular weight range of such polymers. For example, a titanium tetraalkoxide such as titanium isopropoxide may have a number average molecular weight of 1000 or less, or 300 or less, as may be readily calculated. A titanium-modified dispersant, as described above, may include a hydrocarbyl substituent with a number average molecular weight of 3000 or less or 2000 or less, e.g., about 1000.

The amount of titanium, if any, present in the lubricant is typically at least 25 parts per million by weight (as the metal Ti). Such amounts, in combination with the amounts of boron, described below, are believed to impart significantly improved oxidation stability to the lubricant in which they are employed. The amount of titanium may also be at least 25 or at least 35 parts per million. Suitable amounts of titanium thus include 25 to 1000 ppm, or 35 to 100 ppm.

These amounts may vary with the particular system investigated and may be influenced to some extent by the anion or complexing agent associated with the titanium. Also, the overall amount of the particular titanium compound to be employed will depend on the relative weight of the anionic or complexing groups associated with the titanium. Titanium isopropoxide, for instance, is typically commercially supplied in a form which contains 16.8% titanium by weight.

Likewise, different performance advantages may be obtained by using different specific titanium compounds, that is, with different anionic portions or complexing portions of the compound. For example, surface-modified $TiO_2$ particles may impart friction and wear properties. Similarly, tolyltriazole oligomers salted with and/or chelated to titanium may impart antiwear properties. In a like manner, titanium compounds containing relatively long chain anionic portions or anionic portion containing phosphorus or other anti-wear elements may impart anti-wear performance by virtue of the anti-wear properties of the anion. Examples would include titanium neodecanoate; titanium 2-ethylhexoxide; titanium (IV) 2-propanolato, tris-isooctadecanato-O; titanium(IV)2,2 (bis-2-prepenolatomethyl)butanolato, tris-neodecanato-O; titanium(IV)2-propanolato, tris(dioctyl)phosphato-O; and titanium(IV)2-propanolato, tris(dodecyl)benzenesulfanato-O. When any such anti-wear-imparting materials are used, they may be used in an amount suitable to impart—and should in fact impart—a reduction in surface wear greater than surface of a lubricant composition devoid of such compound In certain embodiments, the titanium-containing material may be selected from the group consisting of titanium alkoxides, titanium modified dispersants, titanium salts of aromatic carboxylic acids (such as benzoic acid or alkyl-substituted benzoic acids), and titanium salts of sulfur-containing acids (such as those of the formula R—S—R'—$CO_2H$, where R is a hydrocabyl group and R' is a hydrocarbylene group).

The titanium compound can be imparted to the lubricant composition in any convenient manner, such as by adding to the otherwise finished lubricant (top-treating) or by preblending the titanium compound in the form of a concentrate in an oil or other suitable solvent, optionally along with one or more additional components such as an antioxidant, a friction modifier such as glycerol monooleate, a dispersant such as a succinimide dispersant, or a detergent such as an overbased sulfurized phenate detergent. Such additional components, typically along with diluent oil, may typically be included in an additive package, sometimes referred to as a DI (detergent-inhibitor) package.

Other Additives

Other performance additives such as corrosion inhibitors include those described in paragraphs 5 to 8 of US Application US05/038319 (filed on Oct. 25, 2004 McAtee and Boyer as named inventors), polyisobutylene succinic anhydrides (with a polyisobutylene group having a number average molecular weight of 350 to 2400, or 550 to 2200), octylamine octanoate, and condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor is typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Copper corrosion inhibitors (or metal deactivators) may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles.

Benzotriazoles may contain hydrocarbyl substitutions on at least one of the following ring positions 1- or 2- or 4- or 5- or 6- or 7-. The hydrocarbyl groups may contain 1 to about 30, or 1 to about 15, or 1 to about 7 carbon atoms. In one embodiment the corrosion inhibitor is tolyltriazole. In one embodiment hydrocarbyl benzotriazoles substituted at positions 4- or 5- or 6- or 7- can be further reacted with an aldehyde and a secondary amine.

Examples of suitable hydrocarbyl benzotriazoles further reacted with an aldehyde and a secondary amine include N,N-bis(heptyl)-ar-methyl-1H-Benzotriazole-1-methanamine, N,N-bis(nonyl)-ar-methyl-1H-Benzotriazole-1-methanamine, N,N-bis(decyl)-ar-methyl-1H-Benzotriazole-1-methanamine, N,N-bis(undecyl)-ar-methyl-1H-Benzotriazole-1-methanamine, N,N-bis-(dodecyl)-ar-methyl-1H-Benzotriazole-1-methanamine N,N-bis(2-ethylhexyl)-ar-methyl-1H-Benzotriazole-1-methanamine and mixtures thereof. In one embodiment the corrosion inhibitor is N,N-bis(2-ethylhexyl)-ar-methyl-1H-Benzotriazole-1-methanamine.

In one embodiment, the corrosion inhibitor is 2,5-bis(alkyl-dithio)-1,3,4-thiadiazoles. The alkyl groups of 2,5-bis(alkyl-dithio)-1,3,4-thiadiazoles contains 1 to about 30, or about 2 to about 25, or 4 to about 20, or about 6 to about 16 carbon atoms. Examples of suitable 2,5-bis(alkyl-dithio)-1,3,4-thiadiazoles include 2,5-bis(tert-octyldithio)-1,3,4-thiadiazole, 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, or mixtures thereof.

In one embodiment the lubricating composition contains two or more corrosion inhibitors. When two or more corrosion inhibitors are present, one of the corrosion inhibitors typically includes a triazole (either 1,2,4-triazoles, or benzotriazoles), and any of the other corrosion inhibitors listed above.

In one embodiment the lubricating composition contains two corrosion inhibitors. In one embodiment the lubricating composition contains three corrosion inhibitors. In one embodiment the lubricating composition contains four corrosion inhibitors.

The corrosion inhibitor may be present in ranges of 0 wt % to 1.5 wt %, or 0.0003 wt % to 1.5 wt %, or 0.0005 wt % to 1 wt %, or 0.001 wt % to 0.5 wt % of the lubricating composition.

Foam inhibitors may also be used, including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants including esters of maleic anhydride-styrene, polymethacrylates, polyacrylates or polyacrylamides, may also be used.

INDUSTRIAL APPLICATION

The lubricating composition may be utilised in an internal combustion engine. The internal combustion engine may be a 2-stroke or 4-stroke engine. Typically the internal combustion engine is a 4-stroke engine.

Suitable internal combustion engines include marine diesel engines, aviation piston engines, low-load diesel engines, and automobile and truck engines. In one embodiment the internal combustion engine is suitable for a passenger car.

In one embodiment the internal combustion engine may be a diesel fuelled engine, a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The following examples provide illustrations of the invention. These examples are non-exhaustive and are not intended to limit the scope of the invention.

EXAMPLES

As used herein all of the quantities for dispersants, detergents and viscosity modifiers shown below include conventional amount of diluent oil Typically the diluent oil constitutes 20 wt % to 90 wt % of each component. For antiwear agents, corrosion inhibitors, antioxidants the amounts shown are on an actives basis, i.e., excluding diluent oil, because the components are typically not carried in diluent oil.

Example 1 (EX1)

A 5W-30 lubricating composition is prepared containing 7 wt % of dispersant, 0.5 wt % of zinc dialkyldithiophosphate, 2 wt % of antioxidants (a mixture of phenolic and aminic antioxidants), 0.05 wt % of a titanium compound, 0.15 wt % of corrosion inhibitors, 0.1 wt % of a sulphonate detergent, 2 wt % of phenate detergent. The balance is a API Group III base oil derived from a mixture of 4 $mm^2s^{-1}$ and 6 $mm^2s^{-1}$ oils. The lubricating composition has a sulphated ash content of 0.5 wt %, a phosphorus content of 460 ppm, and a sulphur content of 0.185 wt %. EX1 has a phenate soap content of 1.26 wt %. The soap content of the lubricating composition is 1.283.

Example 2 (EX2)

A 5W-30 lubricating composition is prepared containing 5 wt % of dispersant, 0.5 wt % of zinc dialkyldithiophosphate, 2 wt % of antioxidants (a mixture of phenolic and aminic antioxidants), 0.05 wt % of a titanium compound, 0.3 wt % of corrosion inhibitors, 0.1 wt % of a sulphonate detergent, 2 wt % of phenate detergent. The balance is a API Group III base oil derived from a mixture of 4 $mm^2s^{-1}$ and 6 $mm^2s^{-1}$ oils. The lubricating composition has a sulphated ash content of 0.5 wt %, a phosphorus content of 460 ppm, and a sulphur content of 0.185 wt %.

Example 3 (EX3)

A 5W-30 lubricating composition is prepared containing 5 wt % of dispersant, 0.5 wt % of zinc dialkyldithiophosphate, 1 wt % of antioxidants (a mixture of phenolic and aminic antioxidants), 0.05 wt % of a titanium compound, 0.15 wt % of corrosion inhibitors, 2 wt % of phenate detergent. The balance is a API Group III base oil derived from a mixture of 4 $mm^2s^{-1}$ and 6 $mm^2s^{-1}$ oils. The lubricating composition has a sulphated ash content of less than 0.5 wt %, a phosphorus content of 460 ppm, and a sulphur content of less than 0.185 wt %.

Example 4 (EX4)

A 5W-30 lubricating composition is prepared containing 7 wt % of dispersant, 0.5 wt % of zinc dialkyldithiophosphate, 1.5 wt % of antioxidants (a mixture of phenolic and aminic antioxidants), 0.05 wt % of a titanium compound, 0.2 wt % of corrosion inhibitors, 2 wt % of phenate detergent. The balance is a API Group III base oil derived from a mixture of 4 $mm^2s^{-1}$ and 6 $mm^2s^{-1}$ oils. The lubricating composition has a sulphated ash content of less than 0.5 wt %, a phosphorus content of 460 ppm, and a sulphur content of less than 0.185 wt %.

Example 5 (EX5)

A 5W-40 lubricating composition is prepared containing 5 wt % of dispersant, 0.5 wt % of zinc dialkyldithiophosphate, 2 wt % of antioxidants (a mixture of phenolic and aminic antioxidants), 0.05 wt % of a titanium compound, 0.15 wt % of corrosion inhibitors, 0.1 wt % of a sulphonate detergent, 2 wt % of phenate detergent. The balance is a API Group III base oil derived from a mixture of 4 $mm^2s^{-1}$ and 6 $mm^2s^{-1}$ oils. The lubricating composition has a sulphated ash content of 0.5 wt %, a phosphorus content of 460 ppm, and a sulphur content of 0.185 wt %.

Example 6 (EX6)

A 5W-40 lubricating composition is prepared containing 7 wt % of dispersant, 0.5 wt % of zinc dialkyldithiophosphate, 1 wt % of antioxidants (a mixture of phenolic and aminic antioxidants), 0.05 wt % of a titanium compound, 0.3 wt % of corrosion inhibitors, 0.1 wt % of a sulphonate detergent, 2 wt % of phenate detergent. The balance is a API Group III base oil derived from a mixture of 4 $mm^2s^{-1}$ and 6 $mm^2s^{-1}$ oils. The lubricating composition has a sulphated ash content of 0.5 wt %, a phosphorus content of 460 ppm, and a sulphur content of 0.185 wt %.

Example 7 (EX7)

A 5W-40 lubricating composition is prepared containing 5 wt % of dispersant, 0.5 wt % of zinc dialkyldithiophosphate, 1 wt % of antioxidants (a mixture of phenolic and aminic antioxidants), 0.05 wt % of a titanium compound, 0.3 wt % of corrosion inhibitors, 2 wt % of phenate detergent. The balance is a API Group III base oil derived from a mixture of 4 $mm^2s^{-1}$ and 6 $mm^2s^{-1}$ oils. The lubricating composition has a sulphated ash content of less than 0.5 wt %, a phosphorus content of 460 ppm, and a sulphur content of less than 0.185 wt %.

Example 8 (EX8)

A 5W-40 lubricating composition is prepared containing 7 wt % of dispersant, 0.5 wt % of zinc dialkyldithiophosphate, 2 wt % of antioxidants (a mixture of phenolic and aminic antioxidants), 0.05 wt % of a titanium compound, 0.3 wt % of corrosion inhibitors, 2 wt % of phenate detergent. The balance is a API Group III base oil derived from a mixture of 4 $mm^2s^{-1}$ and 6 $mm^2s^{-1}$ oils. The lubricating composition has a sulphated ash content of less than 0.5 wt %, a phosphorus content of 460 ppm, and a sulphur content of less than 0.185 wt %.

Comparative Example 1 (CE1)

A 5-W30 lubricating oil composition is prepared containing additives and base oil similar to EX1. However, the amounts of detergent, and antiwear chemistry are modified to produce a lubricating composition with a sulphated ash content of about 1.0 wt %, a phosphorus content of 1200 ppm, and a sulphur content of 0.32 wt %. %. CE1 has a phenate soap content of 0.43 wt %. The soap content of the lubricating composition is 0.80.

Comparative Example 2 (CE2)

A 5-W30 lubricating oil composition is prepared containing additives and base oil similar to EX1. However, the amounts of detergent, and antiwear chemistry are modified to produce a lubricating composition with a sulphated ash content of less than 0.5 wt %, a phosphorus content of 460 ppm, and a sulphur content of 0.115 wt %. %. CE2 has a phenate soap content of 0.19 wt %. The soap content of the lubricating composition is 0.213.

Comparative Example 3 (CE3)

A 5-W30 lubricating oil composition is prepared containing additives and base oil similar to EX1. However, the amounts of detergent, and antiwear chemistry are modified to produce a lubricating composition with a sulphated ash content of about 1.0 wt %, a phosphorus content of 1200 ppm, and a sulphur content of 0.32 wt %. %. CE3 has a phenate soap content of 0.43 wt %. The soap content of the lubricating composition is 0.486.

Comparative example 1 is believed to be representative of the examples disclosed in U.S. Patent Application 2007/0149419 and European Patent application 765 931 A. The US patent application discloses examples containing 1 wt % sulphated ash, 1200 ppm of phosphorus, a sulphur content of 0.32 wt %, and a total soap content of 0.80 wt %. The European Patent application discloses examples containing 0.9 wt % sulphated ash, 1400 ppm of phosphorus, a sulphur content of 0.3 wt %, and a total soap content of 0.72 wt %.

Lubricants EX1, CE1, CE2 and CE3 are evaluated in a panel coker deposit test. Approximately 233 g of sample is placed in a 250 ml Panel Coker apparatus and heated to 325° C. The sump temperature is 95° C. The sample is splashed against a metal plate for 15 seconds and then baked for 75 seconds. The splashing and baking cycle is continued for approximately 4 hours, with a spindle speed of 1000 rpm. The airflow during the test is 350 ml $min^{-1}$. The sample is cooled to room temperature and the amount of deposits left on the metal plate is weighed. The results obtained are:

| | CE1 | CE2 | CE3 | EX1 |
|---|---|---|---|---|
| Deposits (mg) | 55.8 | 49 | 51.7 | 25 |

The results indicate that a lubricating composition of the present invention with a low ash content and a high phenate soap content reduces deposit formation compared to CE1 CE2 and CE3.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms; and (iv) heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and a calcium-containing phenate detergent with a soap content of 1 wt % to 1.3 wt % of the lubricating composition, wherein the calcium-containing phenate detergent contributes a total soap content at least 90 wt % of the total amount of soap present in the lubricating composition, and wherein the lubricating composition has a total sulfate ash content of at most 0.5 wt % of the lubricating composition.

2. The lubricating composition of claim 1, wherein the lubricating composition further comprises a dispersant.

3. The lubricating composition of claim 1, wherein the lubricating composition further comprises an ashless dispersant, and wherein the ashless dispersant contributes 0.03 wt % to less than 0.08 wt % of nitrogen to the lubricating composition.

4. The lubricating composition of claim 1, wherein the lubricating composition further comprises an ashless dispersant, and wherein the ashless dispersant contributes 0.04 wt % to 0.07 wt % of nitrogen to the lubricating composition.

5. The lubricating composition of claim 1, wherein the lubricating composition further comprises a dispersant package of (i) a dispersant with a carbonyl to nitrogen ratio of 1 or higher; and (ii) a dispersant with a carbonyl to nitrogen ratio of less than 1.

6. The lubricating composition of claim 1 containing a dispersant derived from an acylating agent made by a "thermal ene" reaction.

7. The lubricating composition of claim 1, wherein the lubricating composition has a total base number (TBN) of 7 mg KOH/g or less.

8. The lubricating composition of claim 1, wherein the lubricating composition is further characterised as having at least one of (i) a sulfur content of 0.5 wt % or less, and (ii) a phosphorus content of 0.1 wt % or less.

9. The lubricating composition of claim 1, wherein the lubricating composition has a sulfur content of 0.01 wt % to 0.3 wt %.

10. The lubricating composition of claim 1, wherein the lubricating composition has a phosphorus content of 300 ppm to 500 ppm.

11. The lubricating composition of claim 1, wherein the calcium-containing phenate detergent is in a mixture with a sulfonate detergent.

12. The lubricating composition of claim 1, wherein the calcium-containing detergent is only a phenate detergent.

13. The lubricating composition of claim 1, wherein the calcium-containing phenate detergent is a sulfur-containing phenate detergent.

14. The lubricating composition of claim 1, wherein the lubricating composition has a ratio of soap from the calcium-containing phenate detergent to sulfated ash of at least 2.

15. The lubricating composition of claim 1 further comprising an oil-soluble titanium-containing additive.

16. The lubricating composition of claim 1 further comprising two or more corrosion inhibitors.

17. The lubricating composition of claim 1 further comprising a 1,2,4-triazole, a benzotriazole, or mixtures thereof.

18. The lubricating composition of claim 1, wherein the oil of lubricating viscosity is an API Group II, III or IV oil.

19. The lubricating composition of claim 1, wherein the oil of lubricating viscosity is an API Group III oil.

20. The lubricating composition of claim 1, wherein the sulfur containing phenate detergent has a TBN of 70 to 170.

21. A method of lubricating an internal combustion engine comprising supplying to the internal combustion engine a lubricating composition of claim 1.

* * * * *